US007913473B2

(12) United States Patent
Schitter

(10) Patent No.: US 7,913,473 B2
(45) Date of Patent: Mar. 29, 2011

(54) METHOD FOR PLACING AND MECHANICALLY CONNECTING PANELS

(75) Inventor: Leonhard Schitter, Hallwang (AT)

(73) Assignee: Interglarion Limited, Nikosia (CY)

( * ) Notice: Subject to any disclaimer, the term of this patent is extended or adjusted under 35 U.S.C. 154(b) by 459 days.

(21) Appl. No.: 11/915,510

(22) PCT Filed: May 24, 2006

(86) PCT No.: PCT/EP2006/004998

§ 371 (c)(1),
(2), (4) Date: Nov. 26, 2007

(87) PCT Pub. No.: WO2006/125646

PCT Pub. Date: Nov. 30, 2006

(65) Prior Publication Data

US 2009/0193753 A1 Aug. 6, 2009

(30) Foreign Application Priority Data

May 27, 2005 (DE) ..... 10 2005 024 366

(51) Int. Cl.
*E04B 1/00* (2006.01)

(52) U.S. Cl. ..... 52/745.2; 52/747.11; 52/747.1; 52/592.4; 52/592.1

(58) Field of Classification Search ..... 52/747.1, 52/539, 582.2, 591.1, 592.1, 592.4, DIG. 1, 52/745.19, 745.2; 29/897.3, 897.32, 428, 29/453

See application file for complete search history.

(56) References Cited

U.S. PATENT DOCUMENTS

| | | | | | |
|---|---|---|---|---|---|
| 531,711 | A | * | 1/1895 | Wilce | 52/474 |
| 1,843,024 | A | * | 1/1932 | Werner | 52/591.1 |
| 2,398,632 | A | * | 4/1946 | Frost et al. | 428/309.9 |
| 4,340,929 | A | * | 7/1982 | Konikoff et al. | 362/153 |
| 4,571,353 | A | * | 2/1986 | Gable, Jr. | 428/33 |
| 5,179,812 | A | * | 1/1993 | Hill | 52/582.2 |
| 5,277,011 | A | * | 1/1994 | Serrano | 52/588.1 |
| 5,706,621 | A | * | 1/1998 | Pervan | 52/403.1 |

(Continued)

FOREIGN PATENT DOCUMENTS

DE 297 10 175 9/1997

(Continued)

OTHER PUBLICATIONS

English Language Abstract of DE 297 10 175.

(Continued)

*Primary Examiner* — Robert J Canfield
*Assistant Examiner* — Matthew J Gitlin
(74) *Attorney, Agent, or Firm* — Greenblum & Bernstein, P.L.C.

(57) ABSTRACT

The invention relates to a method for laying and mechanically connecting panels in rows parallel to one another. The method includes forming a super panel comprising a first plurality of panels in a first panel row, to be newly laid, the super panel being formed by connecting together second pairs of locking elements in adjacent panels of the first panel row. The method also includes connecting the super panel to a second plurality of panels in an already laid second panel row by working in sections, beginning at an end of the super panel, by utilizing a torsional flexibility of the super panel to engage the first pair of locking elements. During the connecting, the first plurality of panels do not move relative to each other along the second pair of edges.

28 Claims, 3 Drawing Sheets

U.S. PATENT DOCUMENTS

| | | | | |
|---|---|---|---|---|
| 6,006,486 | A | 12/1999 | Moriau et al. | |
| 6,023,907 | A * | 2/2000 | Pervan | 52/748.1 |
| 6,119,423 | A * | 9/2000 | Costantino | 52/390 |
| 6,233,899 | B1 * | 5/2001 | Mellert et al. | 52/747.1 |
| 6,505,452 | B1 | 1/2003 | Hannig et al. | |
| 6,546,691 | B2 * | 4/2003 | Leopolder | 52/747.1 |
| 6,672,030 | B2 * | 1/2004 | Schulte | 52/747.1 |
| 6,684,592 | B2 * | 2/2004 | Martin | 52/591.5 |
| 6,766,622 | B1 * | 7/2004 | Thiers | 52/591.3 |
| 6,769,218 | B2 * | 8/2004 | Pervan | 52/591.4 |
| 6,786,019 | B2 * | 9/2004 | Thiers | 52/589.1 |
| 6,804,926 | B1 | 10/2004 | Eisermann | |
| 6,968,664 | B2 * | 11/2005 | Thiers et al. | 52/592.1 |
| 7,065,935 | B2 * | 6/2006 | Ralf | 52/747.1 |
| 7,090,430 | B1 * | 8/2006 | Fletcher et al. | 404/35 |
| 7,275,350 | B2 * | 10/2007 | Pervan et al. | 52/592.1 |
| 7,343,717 | B2 * | 3/2008 | Thiers et al. | 52/592.1 |
| 7,823,359 | B2 * | 11/2010 | Pervan | 52/588.1 |
| 2002/0046528 | A1 * | 4/2002 | Pervan et al. | 52/588.1 |
| 2002/0092263 | A1 | 7/2002 | Schulte | |
| 2002/0178681 | A1 * | 12/2002 | Zancai et al. | 52/592.1 |
| 2004/0200175 | A1 * | 10/2004 | Weber | 52/592.1 |
| 2005/0208255 | A1 * | 9/2005 | Pervan | 428/60 |
| 2006/0032168 | A1 * | 2/2006 | Thiers et al. | 52/390 |
| 2008/0148674 | A1 * | 6/2008 | Thiers et al. | 52/592.1 |

FOREIGN PATENT DOCUMENTS

| | | |
|---|---|---|
| EP | 0 969 164 | 1/2000 |
| EP | 100 38 662 | 2/2002 |
| EP | 1 223 264 | 7/2002 |
| EP | 12 51 219 | 10/2002 |
| EP | 14 28 957 | 6/2004 |
| FR | 28 19 532 | 7/2002 |
| WO | 01/02671 | 1/2001 |

OTHER PUBLICATIONS

English Language Abstract of FR 28 19 532.
English Language Abstract of EP 14 28 957.
English Language Abstract of EP 0 969 164.
Canadian Office Action dated May 4, 2010 in Canadian Appln. No. 2,609,496.
European Opposition filed in European Appln. No. 06 753 868-2303/1 885 970 mailed Jul. 13, 2010 (with English language translation).

* cited by examiner

METHOD FOR PLACING AND MECHANICALLY CONNECTING PANELS

CROSS-REFERENCE TO RELATED APPLICATIONS

The present application is a U.S. National Stage of International Patent Application No. PCT/EP2006/004998 filed May 24, 2006, and claims priority of German Patent Application No. 10 2005 024 366.5 filed May 27, 2005. Moreover, the disclosure of International Patent Application No. PCT/EP2006/004998 is expressly incorporated by reference herein in its entirety.

BACKGROUND OF THE INVENTION

1. Field of the Invention

The invention relates to a method for laying and mechanically connecting panels in rows parallel to one another, the panels having respectively a first pair of side edges lying opposite one another and a second pair of side edges lying opposite one another, a first pair of locking elements being assigned to the first pair of side edges as well as a second pair of locking elements being assigned to the second pair of side edges, the pairs of locking elements being embodied essentially in the form of a tongue and a groove. It is possible to lock two adjacent panels to one another with the aid of the locking elements in a direction running orthogonally to the panel plane as well as in a direction running parallel to the panel plane and orthogonally to the respective side edge. It is also possible to connect the tongue and the groove of the first pair of locking elements to one another by pivoting them into one another.

2. Discussion of Background Information

A method for laying and mechanically connecting panels of this type is known, e.g., from EP 0 969 164 B1. With this method a panel, which is to be added to a panel row that is to be newly laid, is brought to a panel that has already been laid in the panel row to be newly laid.

Next, the panel that has already been laid in the panel row that is to be newly laid is pivoted relative to the panel rows that have already been laid, but without releasing the engagement with the panels that have already been laid.

Finally, one of the short sides of the panel that is to be newly laid is brought to the free short side of the panel that has already been laid in the panel row that is to be newly laid, wherein the panel planes of these two panels form an angle with one another.

After the engagement of the engaging elements of the panel that is to be newly laid with the panel that has already been laid in the panel row that is to be newly laid, the panel planes of the panel that is to be newly laid, of the panel that has already been laid of the panel row that is to be newly laid and of the panels of the panel rows that have already been laid run respectively in pairs at an angle to one another.

In a next step the panel that is to be newly laid and the panel that has already been laid in the panel row that is to be newly laid are pivoted at the same time towards the floor area on which the panel rows are already laid to rest. In order to bring the engagement elements on the long side of the panel that is to be newly laid into engagement with the engagement elements of the panel row that was last laid and to bring the panel planes of the panel that is to be newly laid and the panel that has already been laid in the panel row that is to be newly laid into alignment with the panel plane of the panel rows that has already been laid.

This known method has the disadvantage of being very laborious and difficult to carry out. Either two floorers are required, one of whom manipulates the panel that is to be newly laid in the panel row and the other manipulates the panel that has already been laid in the panel row, or one person must manipulate the panel that is to be newly laid in the panel row with one hand and the panel that has already been laid in the panel row with the other hand. The former case is laborious, because one person cannot lay the panels alone. In the second case, however, a single floorer is faced with the problem that particularly manipulating the panel that is to be newly laid is extremely complicated and requires great strength. This is because the panel that is to be newly laid must be arranged in a very specific spatial orientation and into a very specific relative position to the panel that has already been laid in the panel row, which is to be newly laid, while also taking into account the leverages stemming from the panels that are usually approximately 1.2 m long, 0.2 m wide, and approximately 0.4 kg in weight.

SUMMARY OF THE INVENTION

The aspect of the invention is therefore to disclose a method for laying and mechanically connecting panels of the type mentioned at the outset, wherein the method can be carried out more easily and in particular by one floorer.

This aspect is attained according to the invention by a method of the type mentioned at the outset. Initially, in a first step, a plurality of panels of a panel row that is to be newly laid, and preferably all of the panels of the panel row that is to be newly laid, are connected to one another in pairs by way of locking elements of their respective second pairs of locking elements. In a second step, the panels connected to one another of the panel row that is to be newly laid are connected to the panels of the panel row that has already been laid by pivoting locking elements of their respective first pairs of locking elements into one another. This may be performed by working in sections, in one or more sub-steps, beginning at one of the ends of the panel row that is to be newly laid and utilizing a torsional flexibility of the panels about an axis running parallel to the first pair of side edges, along to the other of its ends. In this method two properties of the panels are utilized, which had not hitherto been considered for use in the course of laying the panels: the strength of the engagement of the locking elements; and the torsional flexibility of the panels about an axis running parallel to its first pair of side edges.

The strength of the engagement of the locking elements of two panels connected to one another is utilized in the first step to form a type of "super panel" from a plurality of panels of a panel row that is to be newly laid. The width of the "super panel" is equal to the measurement of the panels along their second pair of side edges. The length of the super panel is equal to a multiple of the measurement of the panels along their first pair of side edges corresponding to the plurality of panels. In the further manipulation of this super panel in the second step of the laying process of the invention, the individual panels of this super panel do not move relative to one another by themselves due to the strength of the engagement of the locking elements. Although this is not necessarily required, it is recommended to assemble the super panel in the direct vicinity of the panel row that was last laid.

The torsional flexibility of the panels, and thus also of the super panel, is utilized in the second step of the laying method according to the invention to bring the locking elements of the super panel into engagement with the corresponding locking elements of the panel row that was last laid. Although, in principle, the entire super panel could be angled relative to the panel row that has already been laid, a plurality of floorers would be necessary to pivot the engagement elements into one another. According to the invention one therefore begins with a section adjacent to a longitudinal end of the super panel and allows the locking elements of this section to come into engagement with the locking elements of the corresponding section of the panel row that has already been laid. However, this does not mean that once the bringing into engagement has been completed, the panel plane in the area of this section is already aligned with the panel plane of the panel rows that have already been laid. In fact, the mere engagement of the locking elements is sufficient. In this manner one works one's way in sections to the other longitudinal end of the super panel, whereby, due to their torsional flexibility about an axis running parallel to the first pair of side edges, the panels or the super panel perform a gentle "wave movement" from the one longitudinal end of the super panel to the other longitudinal end of the super panel. Once the bringing into engagement the locking elements has been completed, if the super panel has not been pivoted towards the floor surface due to its dead weight, thus completely pivoting the locking elements for connecting the super panel to the panel row already laid into one another, the floorer can accomplish this now, preferably working again from one longitudinal end of the super panel to the other longitudinal end. To sum up, it could be said that the super panel and the panel row that was last laid are connected to one another in a "zipper-like" manner according to the laying method of the invention.

In the manner described above, the panels can also be easily laid by a single floorer without complicated handling.

In producing the super panel it is preferred that the panels of the panel row that is to be newly laid be aligned to one another to prepare for the first step or in the course of carrying out the first step. To make it easier to pivot the locking elements into one another, it is advantageous if the panels are laid in an orientation such that the panels of the panel row that has already been laid present their groove to the panels of the panel row that is to be newly laid. In this case, the alignment of the panels of the panel row that is to be newly laid can be carried out by using the lip near the visible surface of the panels of the panel row that has already been laid as a stop for the tongue of the panels of the panel row that is to be newly laid.

The method according to the invention can be carried out in a particularly simple manner if the torsional flexibility of the panels about an axis running essentially parallel to their first pair of side edges is at least 2°, preferably at least 4°, and even more preferably at least 6°, per meter of length of the panel. This torsional flexibility of a panel can be determined in a measurement independent of the laying, e.g., by clamping a panel of a predetermined length on its two short side edges and then pivoting these two short side edges in the opposite direction of rotation to one another, but without destroying the panel, in particular its visible surface. The value of the angle formed by the two short side edges of the panel determined in this manner then needs only to be divided by the value of the length of the panel measured in meters.

As indicated above, the panels are, e.g., rectangular panels, having the first pair of side edges assigned to the long side of the rectangle and the second pair of side edges assigned to the short side of the rectangle. However, in principle it is also conceivable to perform the laying method according to the invention with square panels.

It is advantageous to strongly lock the two adjacent panels, by the locking elements utilized in the laying method according to the invention, if the first pair of locking elements and/or the second pair of locking elements is embodied in one piece with a core of the panel.

Although, in principle, the laying method according to the invention can also be used with panels having lips of equal length delimiting the groove, in the further development of the invention it is proposed for the groove of the first pair of locking elements to have two lips delimiting the groove, the lip distant from the visible surface of the panel being longer than the lip close to the visible surface of the panel. It can thus be ensured that the tongue of the one panel does not accidentally come into engagement with the relatively rough subsurface of the laying area while it is pivoted into the groove of the other panel, thereby being possibly exposed to the risk of damage. Instead, the tongue can be placed on the longer lower groove-delimiting lip and, sliding thereon, pivoted into the groove. This can be used to simplify the alignment of the panels relative to one another when connecting the panels of the panel row that is to be newly laid to the super panel.

The method according to the invention is particularly advantageous in the use of panels in which the tongue and groove of the second pair of locking elements can also be connected to one another by pivoting into one another. Although in principle the method according to the invention can also be used with panels in which the tongue and groove of the second pair of locking elements can be connected to one another essentially by pushing them together in a planar manner, other laying methods that can easily be carried out by a single floorer also exist for panels of this type.

To simplify the producibility of the panels, it is proposed for the first pair of locking elements and the second pair of locking elements to be embodied in an essentially identical manner.

The method according to the invention can be used particularly advantageously with panels that have a core of a wood-fiber material or a wood-chip material, which if desired is provided with a decorative layer on the side facing the visible surface of the panels and/or with a counteracting layer on the side facing away from the visible surface of the panels. For example, MDF boards (medium density fiberboard) or HDF boards (high density fiberboard) are thereby used as wood-fiber material and, e.g., OSB boards (oriented structural board) as wood-chip material.

It should also be added that the panels are preferably flooring panels.

BRIEF DESCRIPTION OF THE DRAWINGS

The invention is described in more detail below based on an exemplary embodiment by way of the attached drawings. They show.

DETAILED DESCRIPTION OF THE PRESENT INVENTION

Figure 1:
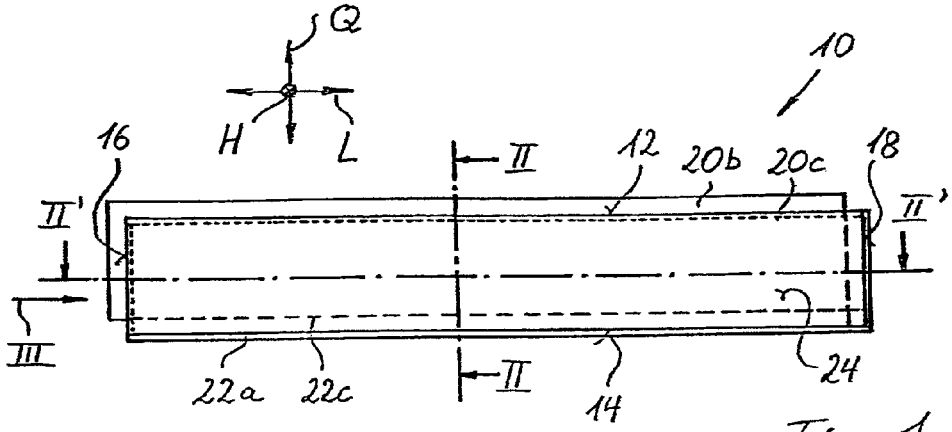
FIG. 1 shows a rough diagrammatic plan view of a panel that can be laid with the aid of the method according to the invention.

In FIG. 1 a panel that can be laid with the aid of the method according to the invention is designated in general by panel 10. The panel 10 is embodied in a rectangular manner and comprises two side edges 12 and 14, running parallel to one another, of the long sides of the panel 10 running in the longitudinal direction L, and two side edges 16 and 18, running parallel to one another, of the short sides of the panel 10 running in the transverse direction Q. Both pairs of side edges 12/14 and 16/18 are provided with locking elements that are embodied essentially in the form of a groove 20 and a tongue 22 (see FIG. 2).

The groove 20 is limited by an upper lip 20*a* near to the visible surface 24 of the panel 10 and by a lower lip 20*b* near to the base area 26 of the panel 10 facing away from the visible surface 24, i.e., distant from the visible surface 24. In the exemplary embodiment shown the lower lip 20*b* is embodied longer than the upper lip 20*a* and projects beyond the side edges 12, 16 of the panel (see FIG. 2). The groove base 20*c* of the groove 20 is indicated by a dotted line in FIG. 1. A locking projection 20*d* projects from the lower lip 20*b* in the vertical direction H of the panel 10 on which projection a locking surface 20*e* is embodied. Furthermore, a groove-limiting surface 20*f* of the lower lip 20*b* running essentially parallel to the visible surface 24 and a groove-limiting surface 20*g* of the upper lip 20*a* likewise running essentially parallel to the visible surface 24 should also be noted.

The tongue 22 begins at a boundary line 22*c*, which is indicated by a broken line in FIG. 1, and designates the end of the main body of the panel 10. Furthermore, an engagement projection 22*a* is provided on the tongue 22, which projection engages under the upper lip 20*a* and in the connected state of two panels shown in FIG. 7*c* bears with a mating surface 22*g* essentially parallel to the visible surface 24 against the groove-limiting surface 20*g* of the groove 20. Furthermore, the tongue 22 has a locking projection 22*d*. On the one hand, a mating surface 22*f* running essentially parallel to the visible surface 24 of the panel 10 is embodied on the locking projection 22*d*, with which mating surface the tongue 22 bears against the lower groove-limiting surface 20*f* of the lower lip 20*b* in the locked state of two adjacent panels according to FIG. 7*c*. On the other hand, a locking surface 22*e* is provided on the locking projection 22*d*, which locking surface bears against the locking surface 20*e* of the groove 20 in the locked state according to FIG. 7*c*. Furthermore, a mating surface 22*h* is also provided on the face of the tongue 22, which mating surface runs essentially orthogonally to the visible surface 24 of the panel 10 and bears against the face 20*h* of the groove 20 in the locked state according to FIG. 7*c*.

Figure 7A:
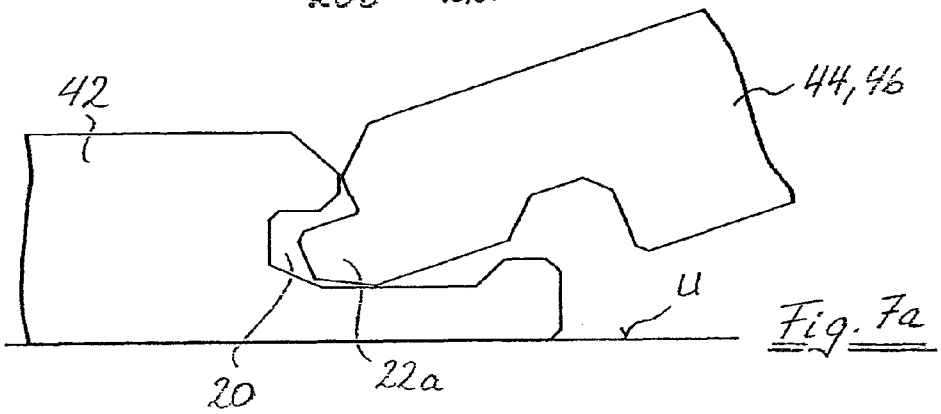
FIGS. 7*a* through 7*c* show views similar to FIG. 2 to explain the pivoting into one another of the locking elements of two adjacent panels.
Figure 7B:
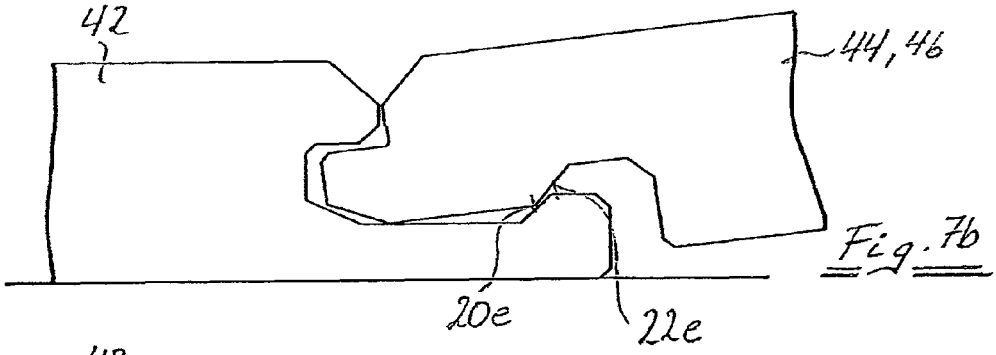
Figure 7C:
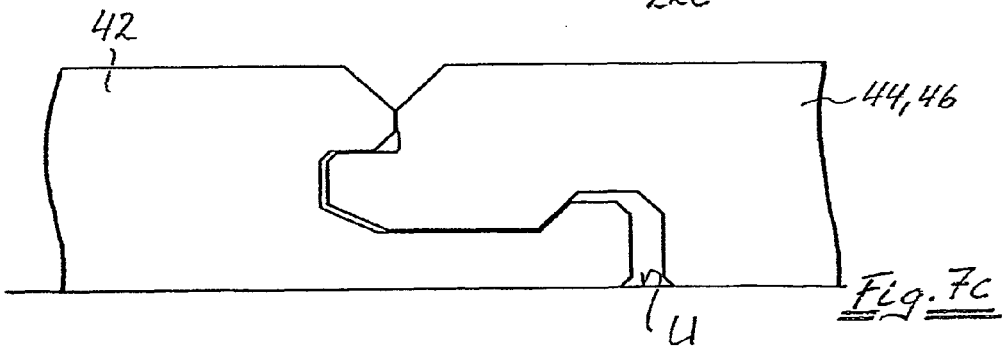

In the locked state of two adjacent panels shown in FIG. 7*c*, the interaction of the surface pairs 20*e*/22*e* and 20*h*/22*h* effects a locking of the two panels to one another in a direction that runs orthogonally to the vertical direction H of the panel and at the same time also orthogonally to the respectively observed side edge. However, the interaction of the surface pairs 20*g*/22*g* and 20*f*/22*f* running essentially parallel to the visible surface 24 of the panel 10 effects a locking of the two panels in the vertical direction H of the panel 10.

Figure 2:
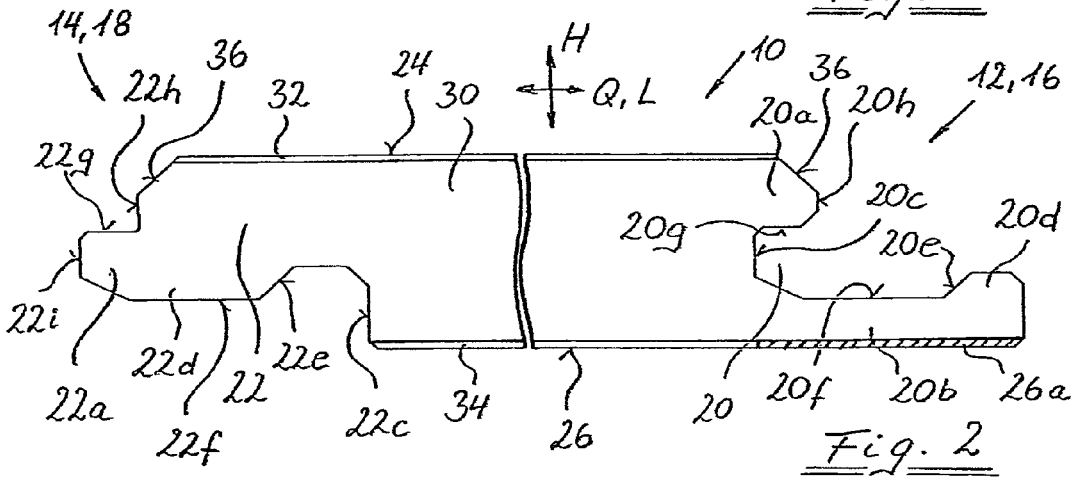
FIG. 2 shows a cross-sectional view along the lines II-II or II'-II' in FIG. 1.

As shown in FIG. 2, the groove 20 is recessed into a core 30 of the panel 10, which core can be made, e.g., of a wood-fiber material, preferably a medium density fiberboard (MDF) or a high density fiberboard (HDF), or a wood-chip material, e.g., an OSB board. The core 30 can be provided with a decorative layer 32 on the visible surface 24 of the panel 10, which decorative layer comprises, e.g., one or more paper layers, the topmost of which can be printed with a desired pattern and which are impregnated with synthetic resin and compressed to form a laminate layer. Analogously, the base surface 26 of the panel 10 can be covered with a counteracting layer 34 which can be made from a plurality of paper layers analogously to the decorative layer 32. The decorative layer 32 as well as the counteracting layer 34 preferably extend over the entire visible surface 24 or base surface 26 of the panel 10. The base area 26 can be free of the counteracting paper 34 only in the area 26*a* shown by shading in FIG. 2, i.e., the area adjacent to the lower lip 20*b*, in order to avoid an undesirable deflection of the lower lip 20*b* downwards in FIG. 2.

It should also be noted that the panel 10 is provided with a chamfer 36 in the area of the side edges 12, 14, 16, 18 adjacent to the visible surface 24. The chamfer produces a V joint in interaction with the corresponding chamfer of an adjacent panel. The V joint has a mainly aesthetic function.

Figure 3:
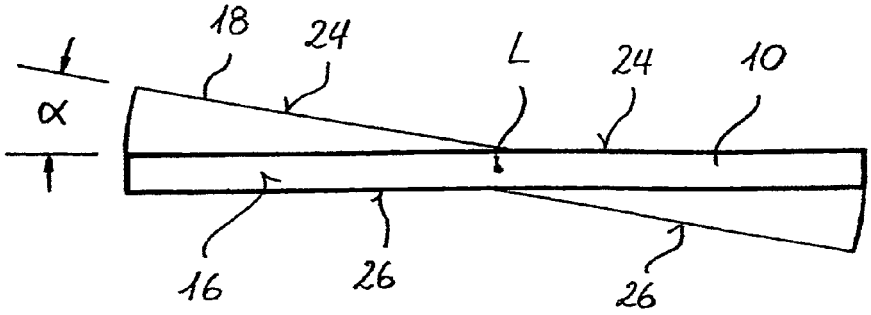
FIG. 3 shows a diagrammatic front view of the panel according to FIG. 1 in a view from the direction of the arrow III in FIG. 1 to explain the term of torsional flexibility.

As shown in FIG. 3, the panels described above have the property that they can be twisted about their longitudinal axis L to a certain extent. Therefore, if the panel 10 is clamped at both short side edges 16 and 18 and these two side edges are twisted in opposite directions about an axis running parallel to the longitudinal axis L of the panel 10, an angle $\alpha$ is produced between the visible surface 24 in a section adjacent to the side edge 16 and the visible surface 24 in a section adjacent to the side edge 18. Of course, the same applies analogously to the base area 26 in the sections adjacent to the side edges 16 and 18. If this torsion angle $\alpha$ is applied to a standard length of the panel 10, e.g., a length of 1 m, then this value measured in the unit "°/m" is a measure of the torsional flexibility of the panel 10.

How this property of torsional flexibility is used by the method according to the invention to lay and mechanically connect the panels is explained below with reference to FIGS. 4 and 5.

Figure 4:
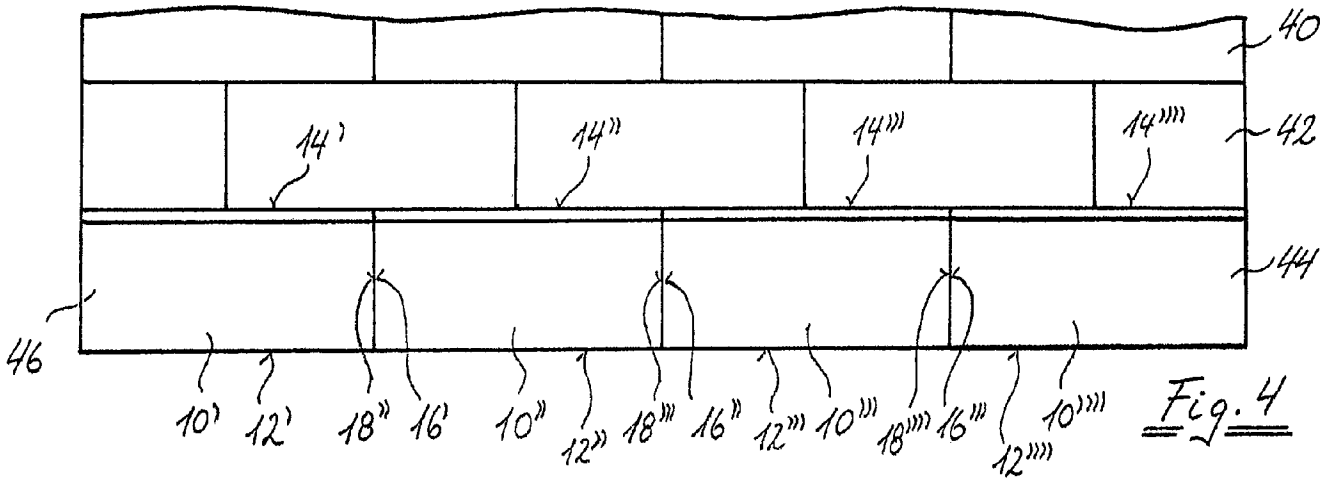
FIGS. 4 and 5 show a diagrammatic plan views of panels laid on a subsurface to explain the method according to the invention.
Figure 5:
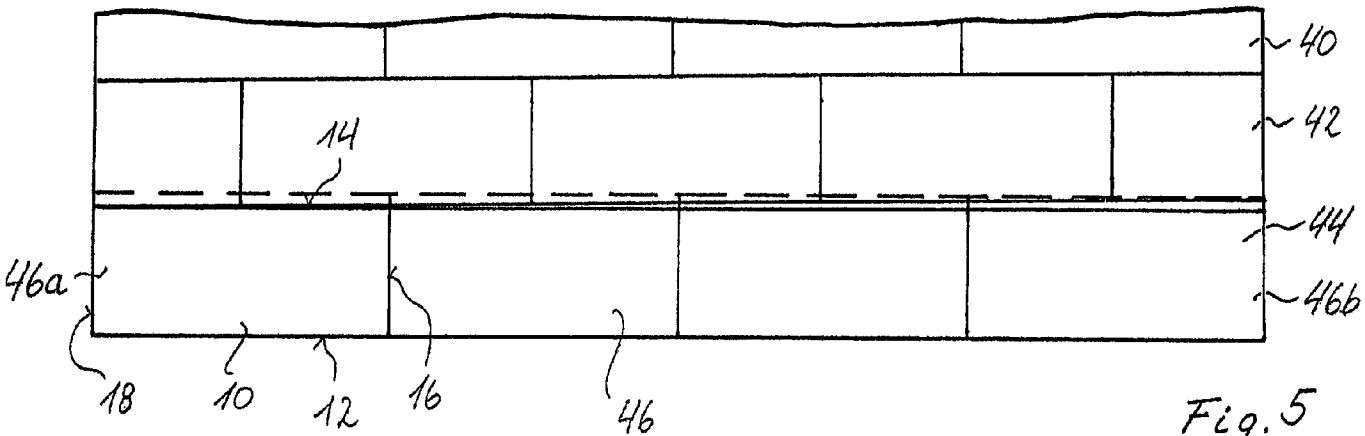

FIG. 4 shows a plurality of rows of panels arranged parallel to one another, namely two already laid panel rows 40 and 42, of which the panel row 42 is the panel row last laid, and a panel row 44 to be newly laid.

In a first step of the method according to the invention, the panels 10', 10" . . . of the panel row 44 to be newly laid are connected to one another in pairs on their short sides 16'/18", 16"/18"", . . . to form a super panel 46. It should thereby be ensured that the long sides 12', 14', 12", 14", . . . of the panels 10', 10" are oriented in alignment with one another.

Figure 6:
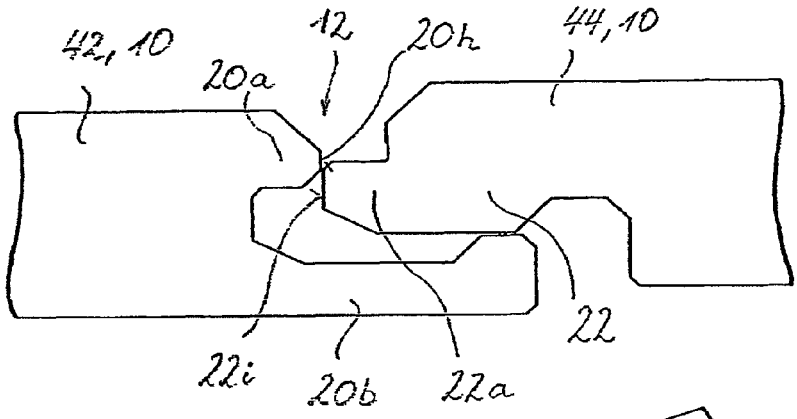
FIG. 6 shows a view similar to FIG. 2 to explain the alignment of a panel row to be newly laid with the aid of the panel row last laid.

If the panels are laid such that the panels of the panel row 42 respectively laid last present their groove side edge 12 in each case to the panels of the panel row 44 to be newly laid, this alignment of the panels of the panel row 44 to be newly laid can be easily carried out at the panel row 42 last laid, as shown in FIG. 6. To this end the panels of the panel row to be newly laid are placed with the tongue 22 on the lower groove-limiting lip 20*b* of the panels of the panel row 42 already laid and the panels of the panel row 44 to be newly laid are pushed towards the panels of the panel row 42 already laid until the face 22*i* of the engagement projection 22*a* of the tongue 22 comes to rest on the face 20*h* of the upper groove-limiting lip 20*a* of the panels of the panel row 42 already laid. This state is shown in section in FIG. 6 and in plan view for the entire panel row 44 to be newly laid or the super panel 46 in FIG. 4.

In a second step of the laying method according to the invention the super panel 46 or the panel row 44 to be newly laid is now connected to the panel row 42 last laid. A floorer hereby works his way from one longitudinal end 46*a* of the super panel 46, in FIG. 5, e.g., the left longitudinal edge of the super panel 46, to the respectively other longitudinal edge 46*b* of the super panel 46 and guides the super panel 46 with its engagement projection 22*a* in sections into the groove 20 of the panel row 42 already laid (see FIG. 7*a*). This procedure by sections is made possible by the above-mentioned torsional flexibility of the panels 10. It is discernible in FIG. 5 that the super panel 46 on the end 46*a* of the left in FIG. 5 has already been brought together with the panels of the panel row laid last, while the end 46*b* on the right in FIG. 5 is still in the alignment position according to FIG. 6.

As already stated above, the floorer now works his way from the one long end 46*a* of the super panel 46 to the other long end 46*b*, thereby guiding the engagement projection 22*a* of the super panel 46 in a zipper-like manner into the groove 20 of the panel row 42 already laid.

With this first sub-step of the second step of the method according to the invention, the mechanical connection between the panel row 44 to be newly laid or the super panel 46 on the one hand and the panel row 42 last laid does not yet need to have been fully completed. Thus it is not necessary, immediately after introducing the engagement projection 22*a* into the groove 20 of the panel row last laid, to pivot the super panel 46 completely to the subsurface U until it bears on the subsurface U, as shown in FIG. 7*c*. Instead, it is sufficient to pivot the super panel 46 by hand into an intermediate position shown in FIG. 7*b*, or to allow it to pivot into this position itself due to the force of gravity, in which position the locking surfaces 20*e* and 22*e* bear against one another only loosely. Once the super panel 46 is in this intermediate position according to FIG. 7*b* over its entire length, then in a second sub-step of the second step of the laying method according to the invention, again working from the one long end 46*a* of the super panel 46 to the other long end 46*b* in sections, the final locking position according to FIG. 7*c* can be produced.

When the laying technique described above is used, the panels 10 can be easily laid by a single floorer in a simple manner that is economical with material.

The invention claimed is:

1. Method for laying and mechanically connecting panels in rows parallel to one another, the panels having a first pair of side edges arranged opposite each other and a second pair of side edges arranged opposite each other, and a first pair of locking elements assigned to the first pair of side edges and a second pair of locking elements assigned to the second pair of side edges, the first pair of locking elements of adjacent panels being connectable together by pivoting the first pair of locking elements into each other, the method comprising:

forming a super panel comprising a first plurality of panels in a first panel row, to be newly laid, the super panel being formed by connecting together second pairs of locking elements of adjacent panels of the first panel row;

connecting the super panel to a second plurality of panels in an already laid second panel row by working in sections, beginning at an end of the super panel; and torsionally flexing the super panel to engage the first pair of locking elements when connecting the super panel to the second plurality of panels, wherein, during the connecting, the first plurality of panels does not move relative to each other along the second pair of edges.

2. The method of claim 1, wherein the torsional flexibility is located about an axis running parallel to the first pair of side edges.

3. The method of claim 1, wherein a width of the super panel is equal to a width of a panel of the first plurality of panels along the second pair of side edges.

4. The method of claim 1, wherein a length of the super panel is equal to a multiple of a length of a panel of the first plurality of panels along the first pair of side edges.

5. The method of claim 1, wherein, before the connecting, the super panel bears against a subsurface.

6. The method of claim 1, wherein the first pair of locking elements and the second pair of locking elements are in the form of a tongue and a groove.

7. The method of claim 6, wherein the tongue and the groove of the first pair of locking elements are configured to connect to one another by pivoting them into one another.

8. The method of claim 6, further comprising placing the tongues of the first plurality of panels of the first panel row into the grooves of the second plurality of panels of the second panel row and pivoting the first plurality of panels relative to the second plurality of panels such that a visible surface of the first plurality of panels and the second plurality of panels are arranged in one plane.

9. The method of claim 6, wherein the groove of a panel of the first pair of locking elements comprises two lips structured to limit the groove.

10. The method of claim 9, wherein a first lip is distant from a visible surface of the first plurality of panels and is longer than a second lip, which is near the visible surface of the first plurality of panels.

11. The method of claim 6, wherein the groove and the tongue of the second pair of locking elements are configured to connect to one another by pivoting them into one another.

12. The method of claim 1, wherein the first plurality of panels are adjacent to one another.

13. The method of claim 1, wherein, after the connection of the first plurality of panels, the panels are locked in a direction running perpendicular to a panel plane and parallel to the first pair of side edges and the second pair of side edges.

14. The method of claim 1, wherein the first plurality of panels are aligned with one another before forming the super panel.

15. The method of claim 1, wherein the first plurality of panels are aligned with one another while forming the super panel.

16. The method of claim 1, wherein the first plurality of panels are laid in an orientation such that the second plurality of panels in the second panel row present a groove to the first plurality of panels in the first panel row.

17. The method of claim 16, further comprising a lip structured to limit the groove and stop a tongue of the first plurality of panels in the first panel row.

18. The method of claim 17, wherein the lip is adjacent to a visible surface of the second plurality of panels in the second panel row.

19. The method of claim 1, wherein the torsional flexibility of the first plurality of panels about an axis running parallel to the first pair of side edges is at least 2° per meter length of the first plurality of panels.

20. The method of claim 1, wherein the torsional flexibility of the first plurality of panels about an axis running parallel to the first pair of side edges is preferably at least 4° per meter length of the first plurality of panels.

21. The method of claim 1, wherein the torsional flexibility of the first plurality of panels about an axis running parallel to the first pair of side edges is preferably at least 6° per meter length of the first plurality of panels.

22. The method of claim 1, wherein the first plurality of panels are rectangular panels.

23. The method of claim 22, wherein the first pair of side edges are assigned to a long side of the rectangle panels and the second pair of side edges are assigned to a short side of the rectangle.

24. The method of claim 1, wherein at least one of the first pair of locking elements and the second pair of locking elements are embodied in one piece with a core of the first plurality of panels and the second plurality of panels.

25. The method of claim 1, wherein the first pair of locking elements and the second pair of locking elements are identical.

26. The method of claim 1, wherein the panels of the at least one of the first plurality of panels and the second plurality of panels comprise a core of a wood-fiber material or a wood-chip material.

27. The method of claim 26, wherein the core is covered with a decorative layer on at least one of a side facing a visible surface of the first or second plurality of panels and a side facing away from the visible surface of the first or second plurality of panels having a counteracting layer.

28. Method for laying and mechanically connecting panels in rows parallel to one another, the panels having a first pair of locking elements associated with a first pair of oppositely arranged side edges and a second pair of locking elements associated with a second pair of oppositely arranged side edges, the method comprising:

forming a super panel by connecting a first plurality of panels in a first panel row, to be newly laid, to one another via the second pair of locking elements; and connecting the super panel to an already laid second panel row comprising a second plurality of panels, wherein the connecting utilizes a torsional flexibility of individual panels of the super panel to insert one of the first pair of locking elements of the super panel into the other of the first pair of locking elements of the second panel row from one end of the super panel to the other; and pivoting the super panel from the one end to the other into a common plane with the second panel row.

* * * * *